US006148461A

United States Patent [19]

Cook et al.

[11] Patent Number: 6,148,461

[45] Date of Patent: Nov. 21, 2000

[54] INFLATABLE SUPPORT

[75] Inventors: Stephen John Cook, Reading; Alastair George McLeod, Rugby; Rolf Schild, London, all of United Kingdom

[73] Assignee: Huntleigh Technology, PLC, United Kingdom

[21] Appl. No.: 09/130,797

[22] Filed: Aug. 7, 1998

[30] Foreign Application Priority Data

Aug. 9, 1997 [GB] United Kingdom ..... 9716852

[51] Int. Cl.[7] ..... A61G 7/057; A47G 27/10

[52] U.S. Cl. ..... 5/713; 5/710; 5/706

[58] Field of Search ..... 5/706, 710, 711, 5/712, 713, 714, 935

[56] References Cited

U.S. PATENT DOCUMENTS

| | | | |
|---|---|---|---|
| 3,674,019 | 7/1972 | Grant | 5/713 X |
| 3,822,425 | 7/1974 | Scales | 5/710 |
| 4,193,149 | 3/1980 | Welch | 5/713 |
| 4,225,989 | 10/1980 | Corbett et al. | 5/714 X |
| 4,639,960 | 2/1987 | Quillen et al. | 5/710 |
| 4,685,163 | 8/1987 | Quillen et al. | 5/710 |
| 4,803,744 | 2/1989 | Peck et al. | 5/706 X |
| 4,953,247 | 9/1990 | Hasty | 5/713 |
| 5,020,176 | 6/1991 | Dotson | 5/710 |
| 5,129,115 | 7/1992 | Higgins et al. | 5/713 |
| 5,249,318 | 10/1993 | Loadsman | 5/710 |
| 5,564,142 | 10/1996 | Liu | 5/710 X |
| 5,619,764 | 4/1997 | Lopau | 5/713 |
| 5,680,036 | 10/1997 | Kopfstein et al. | 5/713 |
| 5,890,245 | 4/1999 | Klearman et al. | 5/714 |
| 5,966,762 | 10/1999 | Wu | 5/710 |

FOREIGN PATENT DOCUMENTS

| | | | |
|---|---|---|---|
| 626272 | 10/1961 | Italy | 5/714 |
| 2197192 | 5/1988 | United Kingdom | 5/713 |

*Primary Examiner*—Terry Lee Melius
*Assistant Examiner*—Robert G. Santos
*Attorney, Agent, or Firm*—Brown Raysman Millstein Felder & Steiner LLP

[57] ABSTRACT

A low air loss mattress continuously supports a person lying thereon, and includes an upper layer of inflatable cells, and a separate lower layer of inflatable cells. The lower layer of inflatable cells is always maintained at a constant pressure which is higher than the pressure in the upper layer of cells to prevent a person lying on the mattress from contacting the underlying support surface, in particular, when sitting or during transport. Cells forming the upper layer may be inflated at different pressures to provide optimum support to different parts of the body.

30 Claims, 4 Drawing Sheets

INFLATABLE SUPPORT

BACKGROUND OF THE INVENTION

1. Field of the Invention

The invention relates generally to low air loss support systems and more particularly to a low air loss mattress which can be used on hospital beds.

2. Discussion of Related Art

In recent years, low air loss beds have come into extensive use and are used widely in hospitals to prevent and treat decubitus ulcers which are commonly referred to as bed sores. A primary cause of bed sores is the inability of the patient to move so as to relieve pressure points. These pressure points typically occur in the area of a bony protuberance which results in a cut-off of the blood flow in the skin and soft tissue adjacent to the protuberance when distortion of capillary beds curtails blood flow. When the blood flow in the capillaries is blocked due to excessive external (interface) pressure, the cells in that area begin to die and may result in a wound which is called a bed sore. Mobile persons do not have this problem because they continually move even when asleep which eliminates the cut-off of blood flow for too long a period.

A typical low air loss support system has a plurality of parallel gas or vapor-permeable cells inflated to provide support for the patient. The low air loss support systems provide gradual leakage of air from the cells, either by having holes at selected locations or by providing a cell material which is permeable to air. Usually, air is pumped from a manifold on one side of the bed through the cells extending transversely of the bed. The air is wholly or partially exhausted through the holes or pores in the cells. The air losses necessitate the use of a rather large air pump, and the systems constructed of this type tend to be bulky and expensive.

Ideally, each inflatable cell should have a sufficient height to allow a substantial amount of depression of each cell for supporting the patient over a larger surface area and the pressure within the inflated cell should be as low as possible to maximize the pressure-reducing effect. However it is important that no part of the mattress is depressed to such an extent by the patient lying thereon that the patient makes contact with any underlying support surface. Such a problem is frequently encountered when a patient is in the sitting position on the bed or in the event of a power failure when the cells continue deflating through air loss through the holes but the pump is no longer inflating the cells. A similar problem may occur during transport of a patient when the cells may have to be disconnected from the pump for a period of time.

SUMMARY OF THE INVENTION

The present invention is designed to alleviate these problems of the existing low air loss support systems.

According to the invention, a low air loss mattress comprises an upper layer of inflatable cells, means for inflating the upper layer of cells so that when inflated the layer continuously and directly supports a patient lying thereon, the upper layer overlying a lower layer of inflatable cell(s) and means for inflating and retaining separately the lower layer at a higher constant pressure. The lower layer of cell(s) inflated and retained at a higher pressure provides a "safety net" for a patient supported on the mattress and prevents the patient contacting the underlying support surface in the event of the patient sitting on the mattress or during transport of the patient or power failure. Advantageously, the lower layer retained at the higher pressure further gives optimum contact area for the patient when in the sitting or near sitting positions on the mattress.

The air pressure in the lower layer may be retained by conventional means, for example, a non-return valve or by solenoids. Preferably, the lower layer is maintained at the higher pressure by means of a control system which periodically boosts the pressure, to compensate for leakage in the system.

Preferably, the upper surface of the cells have holes with the holes allowing air passage therethrough to provide ventilation for a patient lying thereon. Preferably, the inflation pressure in the cells in the upper layer is adjustable to provide different cells at different pressures to provide optimum support to the different parts of the body to be supported thereon. For example, the buttocks of the patient are heavier than the head or the heels which would require less pressure for optimum support than the buttocks.

According to another aspect, the invention covers a method of providing an inflatable support for a patient comprising the steps of providing an inflatable support having an upper layer of cells and a lower layer of cells, inflating both layers to a maximum pressure, isolating the lower layer at that pressure and retaining the lower layer at that pressure and automatically adjusting the upper layer to a pressure to provide optimum support for a patient according to the patient's weight or similar physical characteristics.

BRIEF DESCRIPTION OF THE DRAWINGS

An example of the present invention will now be described with reference to the accompanying drawings in which.

DETAILED DESCRIPTION OF THE PREFERRED EMBODIMENTS

Figure 1:
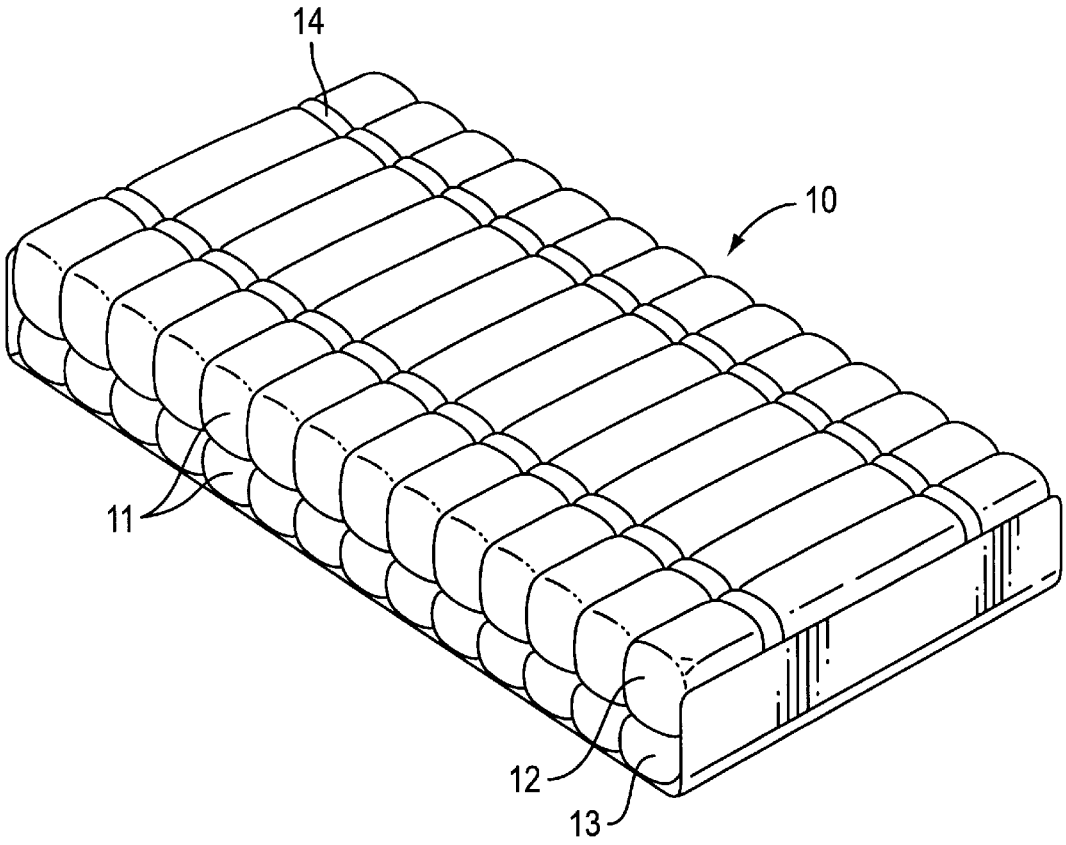
FIG. 1 is a schematic diagram of the low air loss mattress according to the invention.
Figure 2:
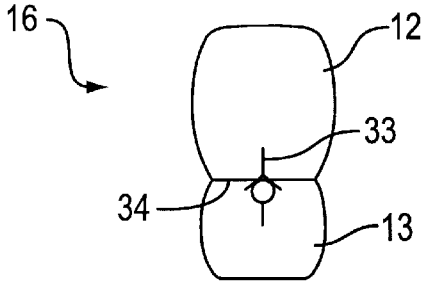
FIG. 2 is a schematic diagram of a cell comprising integral upper and lower layers.

Referring to FIG. 1, a mattress 10 comprises a plurality of inflatable tubes 11 which form two layers 12, 13, with each layer consisting of tubes arranged in parallel extending transversely to the length of the mattress 10. The tubes 11 in the upper layer 12 are held substantially vertically above the tubes 11 in the lower layer 13 by means of straps 14 or retainers on a cover (not shown) covering the tubes to present a smooth surface for a patient to lie on. Alternately, as shown in FIG. 2, the upper layer 12 and lower layer 13 are formed by double chamber cells 16 having one-way valves 33 in the wall 34 separating the chambers. The lower layer 13 may be a single cell extending continuously under the multi-celled upper layer, or either/both layers may comprise longitudinal tubular cells or either/both layers may comprise non-tubular cells.

Figure 3:
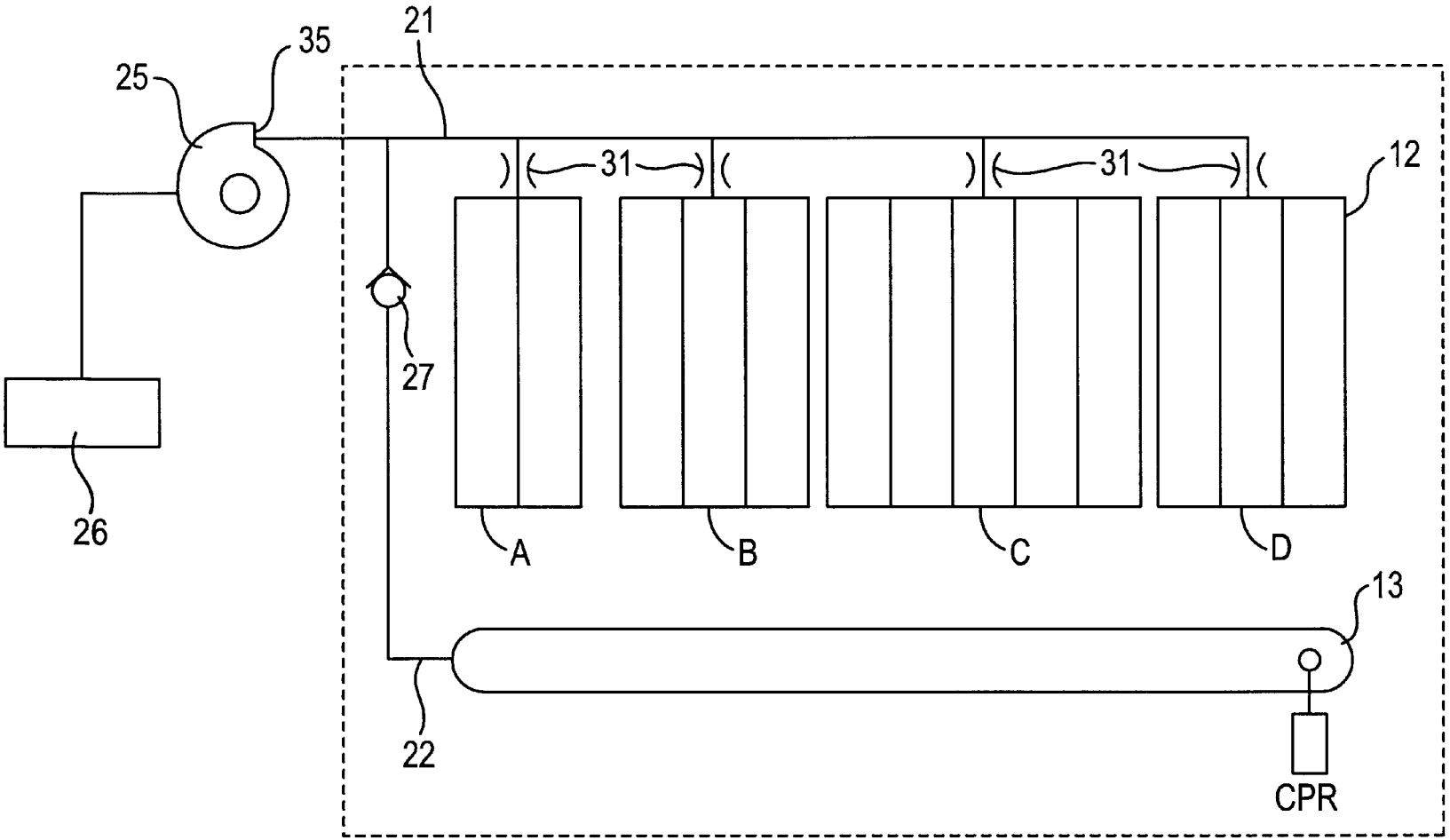
FIG. 3 is a schematic diagram of one embodiment of a low air loss system according to the invention.
Figure 4:
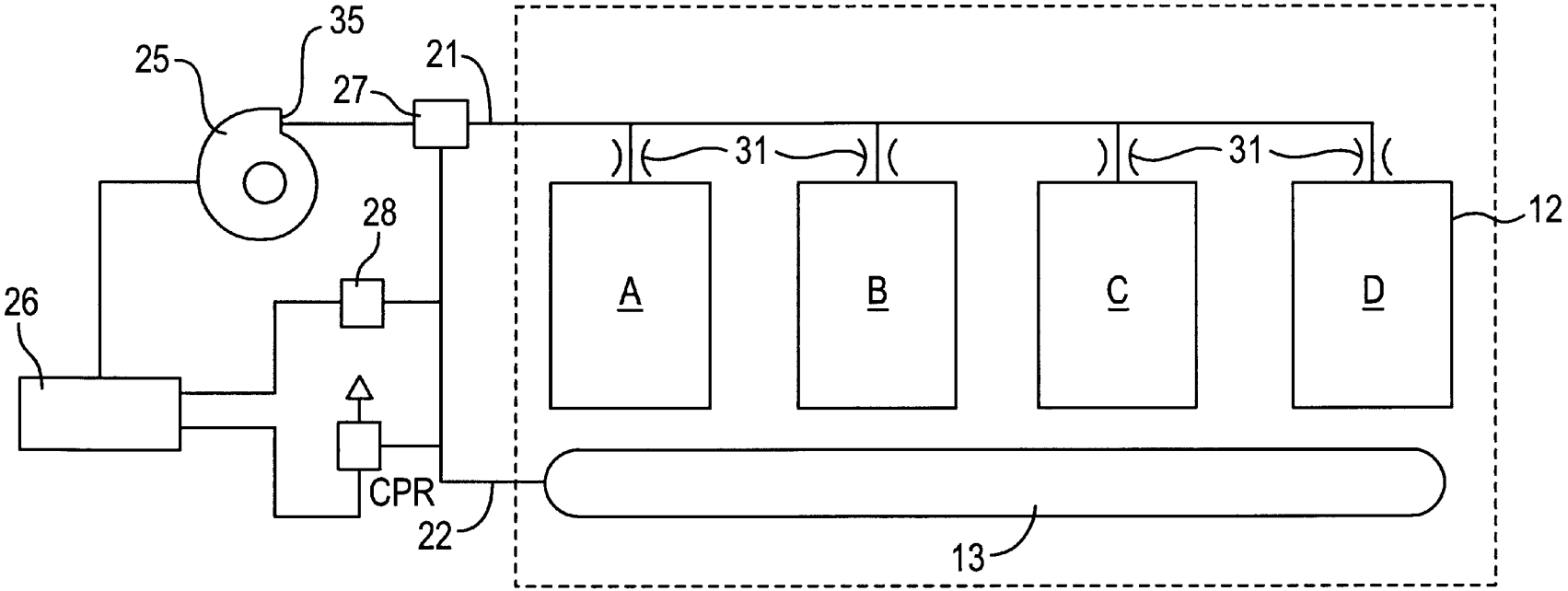
FIG. 4 is a schematic diagram of a second embodiment of a low air loss system according to the invention.
Figure 5:
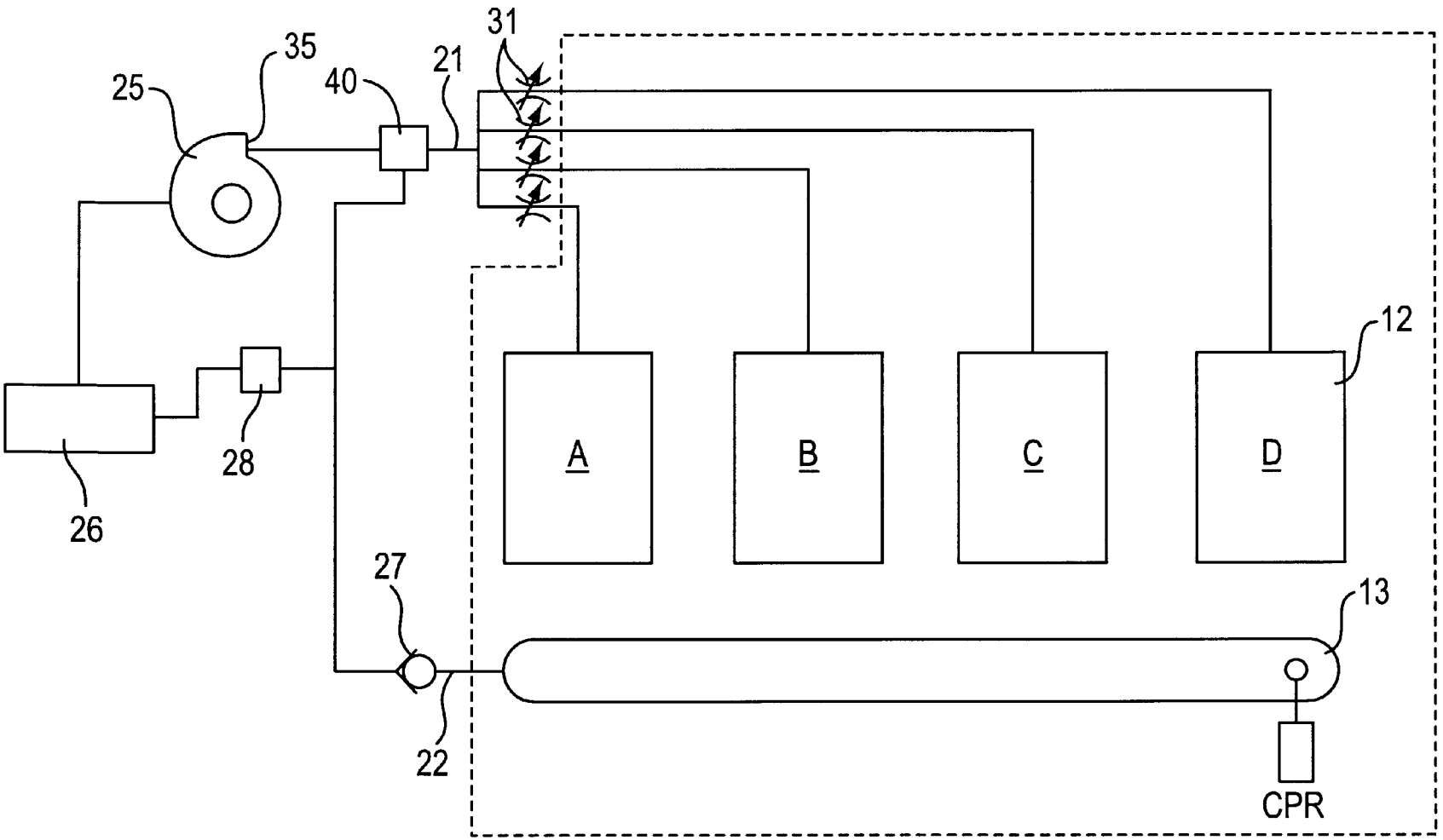
FIG. 5 is a schematic diagram of a third embodiment of a low air loss system according to the invention.

The upper surface of the tubes 11 has ventilation holes, and as shown in FIGS. 3 to 5 each tube 11 on the upper layer 12 is connected to a manifold 21 for supplying compressed air from a compressor 25. The tubes 11 comprising the lower layer 13 are similarly connected to a second manifold 22 leading from the compressor 25. The tubes 11 in the upper layer 12 are arranged in sections A, B, C, D, and each section is arranged to be inflated to different pressures depending upon the area of the patient supported thereon. Section A may support the heels, Section B, the thighs, Section C, the buttocks and Section D the head. The tubes 11 within a section may be connected to the manifold 21 by restrictors or variable orifices 31 so that each section is inflated to a different pre-set pressure. The outlet 35 from the compressor 25 may be supplied directly to both of the manifolds 21, 22 feeding the upper layer 12 and the lower layer 13, respectively, or via a non-return valve 27, as in FIGS. 3–5, and/or a plenum chamber 40, as in FIG. 5.

Figure 6:
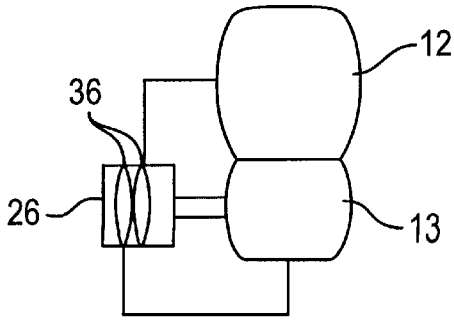
FIG. 6 is a schematic diagram of a pressure controller comprising bellows.

The pressure in the tubes 11 is set by means of a pressure controller 26 which may have input from a pressure sensor 28, as shown in FIGS. 4–5. or the pressure controller 26 may comprise bellows 36 as shown in FIG. 6. The pressure in the lower layer 13 is always pre-set at a level higher than the pressure in the upper layer 12. The pressure in the upper layer 12 may be set to correspond to the weight or other similar characteristic of the patient to be supported thereon. Both of the layers 12,13 may be inflated to a pre-set maximum pressure with the lower layer 13 then sealed and retained at that pressure by means of a non-return valve 27 or similar devices at the outlet from the compressor 25. The pressure in the upper layer 12 then automatically adjusts to a pressure which is calculated to provide the optimum support according to the weight of the patient to be supported thereon. When the pressures in either of the layers 12,13 is less than the pre-set or adjusted pressures respectively, either due to excessive air loss through the air holes in the upper layer 12 or leakage in the lower layer 13, the pressure controller 26 will activate the compressor 25 to boost the pressure in the respective layers 12,13 to the set values. Since the lower layer 13 is inflated and sealed at the same pressure, the compressor 25 only has to maintain the low air loss system within the lesser volume of the upper layer 12 thereby allowing a smaller less expensive compressor to be used.

FIG. 3 shows a low air loss system comprising a single air supply with the pressures in the upper layer 12 controlled by pneumatic restrictors 31.

FIG. 4 shows a low air loss support system comprising a dual air supply with the pressures in the layers 12,13 controlled by inputs from a pressure sensor 28. FIG. 5 shows a similar configuration to FIG. 4 with a multiple air supply to the mattress 10 via a plenum chamber 40.

The low air loss mattress 10 may comprise an upper layer 12 adjusted to the same pressure throughout and not at different pressures.

In use, the low air loss mattress 10 is used in lieu of the standard bed mattress or alternately may be laid on top of the bed mattress, if desired. The low air loss system may be incorporated in a similar application of a cushion, pad or similar inflatable support for a patient for lying or sitting thereon.

What is claimed is:

1. A low air loss mattress comprising:

a lower layer of inflatable cells;

an upper layer of inflatable cells, wherein the upper level is overlying the lower layer such that each cell in the upper layer is positioned substantially vertically above an adjacent cell of the lower layer;

at least one securing member for securing the cells in the upper layer in the substantially vertically positioning above the respective adjacent cells in the lower layer;

means for inflating the upper layer of cells with air to a first pressure so that, when inflated, the upper layer continuously and directly supports a patient lying thereon; and means for inflating with air and retaining separately the lower layer at a constant second pressure higher than the first pressure.

2. A low air loss mattress as claimed in claim 1, wherein the lower layer is maintained at the higher second pressure by a control system which periodically boosts the second pressure, to compensate for air leakage from the lower layer.

3. A low air loss mattress as claimed in claim 1, wherein the upper surface of the cells in the upper layer includes holes therethrough allowing the passage of air therethrough to provide ventilation for a patient lying on the upper layer.

4. A low air loss mattress as claimed in claim 1, wherein the pressure in at least one of the cells in the upper layer upon inflation is adjustable to provide different cells at different pressures to provide optimum support to the different parts of the body to be supported thereon.

5. The low air loss mattress of claim 1, further comprising: control means, connected to at least one of the means for inflating the upper layer and the means for inflating the lower layer, for controlling the supply of air to the upper and lower layers, respectively.

6. The low air loss mattress of claim 5, wherein the control means includes a non-return valve.

7. The low air loss mattress of claim 5, wherein the control means includes a plenum chamber.

8. The low air loss mattress of claim 5, wherein the control means includes bellows.

9. The low air loss mattress of claim 5, wherein the control means includes a pressure sensor, responsive to detection of the pressure in at least one of the means for inflating the upper layer and the means for inflating the lower layer, for maintaining a constant pressure therein.

10. The low air loss mattress of claim 1, wherein the at least one securing member comprises a strap.

11. The low air loss mattress of claim 1, wherein at least one of the cells in the upper layer has a substantially flat surface overlying the adjacent cell of the lower layer.

12. A method of providing an inflatable support for a patient comprising the steps of:

providing the inflatable support having an upper layer of cells and a lower layer of cells, wherein each cell in the upper layer is positioned substantially vertically above an adjacent cell in the lower layer;

securing the cells in the upper layer in the substantially vertically positioning above the respective adjacent cells in the lower layer;

inflating both of the upper and lower layers to a respective maximum pressure, isolating the lower layer at its respective maximum pressure and retaining the lower layer at its respective pressure, and decreasing the inflation pressure of the upper layer to a pressure providing optimum support for a patient according to a physical characteristic of the patient, including the weight of the patient.

13. The method of claim 12, further comprising the step of: periodically boosting the pressure in the lower layer to compensate for air leakage therefrom to maintain a constant pressure in the lower layer.

14. The method of claim 12, further comprising the step of: providing an upper surface of the cells in the upper layer with holes therethrough to allow the passage of air therethrough to provide ventilation for a patient lying on the upper layer.

15. The method of claim 12, wherein the step of adjusting includes the step of:

adjusting the pressure in at least one of the cells in the upper layer to provide different cells at different pressures to provide the optimum support to the different parts of the patient.

16. The method of claim 12, wherein at least one of the cells in the upper layer has a substantially flat surface overlying the adjacent cell of the lower layer.

17. A low air loss mattress comprising:

a lower layer of inflatable cells;

an upper layer of inflatable cells, wherein the upper layer is overlying the lower layer such that each cell in the upper layer is positioned substantially vertically above an adjacent cell of the lower layer;

at least one securing member for securing the cells in the upper layer in the substantially vertically positioning above the respective adjacent cells in the lower layer;

a compressor, connected to the upper and lower layers by at least one manifold, for inflating the upper and lower layers with air, wherein the upper layer, when inflated, continuously and directly supports a patient lying thereon; and a control device for controlling the inflation of the upper and lower layers by the compressor, with the inflation of the lower layer being separate from inflation of the upper layer, and for maintaining the lower layer at a constant pressure higher than an upper layer pressure.

18. The low air loss mattress of claim 17, wherein the control device causes the compressor to inflate the upper and lower layers to have first and second pressures, respectively, wherein the second pressure in the lower layer is the constant pressure, and wherein the second pressure is higher than the first pressure in the upper layer.

19. The low air loss mattress of claim 17, wherein the control device includes a non-return valve.

20. The low air loss mattress of claim 17, wherein the control device includes a plenum chamber.

21. The low air loss mattress of claim 17, wherein the control device includes bellows.

22. The low air loss mattress of claim 17, wherein the control device causes the compressor to periodically boost the pressure in the lower layer to compensate for air leakage from the lower layer.

23. A low air loss mattress of claim 17, wherein the upper surface of the cells in the upper layer include holes therethrough allowing the passage of air therethrough to provide ventilation for a patient lying on the upper layer.

24. The low air loss mattress of claim 17, wherein the at least one securing member comprises a strap.

25. The low air loss mattress as claimed in claim 17, wherein the pressure in at least one of the cells in the upper layer is adjustable to provide different cells at different pressures whereby optimum support to different parts of the body may be achieved.

26. The low air loss mattress as claimed in claim 17, wherein at least one of the cells in the upper layer has a substantially flat surface overlying the adjacent cell of the lower layer.

27. A low air loss mattress comprising:

a lower layer of one or more inflatable cells;

an upper layer of inflatable cells, wherein each cell in the upper layer is a separate chamber of a cell in the lower layer in fluid communication with the corresponding lower layer cell through a one-way valve in the wall separating the chamber from the lower layer cell;

means for inflating with air and retaining separately the lower layer at a constant pressure; and means for inflating the upper layer of cells with air to a pressure lower than that of the lower layer, thereby permitting the upper layer, wherein inflated, to continuously and directly support a patient lying thereon.

28. A low air loss mattress as claimed in claim 27, wherein the lower layer is maintained at the higher second pressure by a control system which periodically boosts the second pressure.

29. A low air loss mattress as claimed in claim 27, wherein each cell in the upper layer is positioned substantially vertically above an adjacent cell of the lower layer.

30. A low air mattress as claimed in claim 27, wherein the pressure in at least one of the cells in the upper layer is adjustable to provide different cells at different pressures.

* * * * *